United States Patent [19]

Quinnell

[11] Patent Number: 4,622,789

[45] Date of Patent: Nov. 18, 1986

[54] ROOFING SYSTEMS

[75] Inventor: Geoffrey C. Quinnell, Pembury, England

[73] Assignee: Marley Tile A.G., Zurich, Switzerland

[21] Appl. No.: 643,379

[22] Filed: Aug. 23, 1984

[30] Foreign Application Priority Data

Aug. 30, 1983 [GB] United Kingdom ..... 8323160
Mar. 19, 1984 [GB] United Kingdom ..... 8407049

[51] Int. Cl.[4] ..... E04D 13/16
[52] U.S. Cl. ..... 52/95; 52/199; 52/DIG. 15
[58] Field of Search ..... 52/94, 95, 199, 303, 52/553, DIG. 15

[56] References Cited

FOREIGN PATENT DOCUMENTS 45489 7/1981 European Pat. Off. .
2096667 10/1982 United Kingdom .
2124266 2/1984 United Kingdom ..... 52/199
2131845 6/1984 United Kingdom .

*Primary Examiner*—Billy S. Taylor
*Assistant Examiner*—Daniel P. Stodola
*Attorney, Agent, or Firm*—Bacon & Thomas

[57] ABSTRACT

A roofing system includes a filler member (12) engaging the under sides of the tiles (3) at the eaves of the roof. The filler member (12) is carried by a strip (13) which is pivotable on a spacer member (4), having ventilation apertures (6), the spacer member (4) being secured to the top of an underlying fascia board (1). The strip (13), which is also effective to support the roofing felt (14), extends inwardly from the spacer member (4) and engages the rafters (2), whereby to locate the filler member (12) at a desired inclination relative to the tiles (3).

8 Claims, 14 Drawing Figures

4
5
6
7
8
9
10
IIb
IIb

ROOFING SYSTEMS

This invention relates to roofing systems, and relates in particular to roofing systems wherein the outer roof covering has contoured upper and lower surfaces, as is the case with a roof covering consisting for example of profiled roof tiles or slates.

Many modern roof tiles are profiled in cross-section in order to provide a contoured roof surface for reasons of adequate drainage of water from the roof and/or to improve the appearance of the roof. In accordance with traditional tile fabricating techniques, however, the underneath surfaces of such profiled tiles are likewise contoured, and this can cause problems in that spaces are often defined beneath the tiles at the eaves of the roof which can provide access into the roof space for birds and insects. In order to avoid this problem, it is known to provide filler members beneath the tiles at the eaves which engage and conform to the shape of the contoured under surfaces of the tiles. Such filler members have typically been secured e.g. by nailing to the top of a fascia board or the like which supports the roof covering at the eaves. However, with known such arrangements where the filler members are effectively fixedly secured to the fascia board or the like, it is generally not possible with a particular design and mounting of filler member to accommodate a range of different roof pitches efficiently, since the filler members will lose their effectiveness if they do not engage the under side of the tiles at an appropriate angle of attack, usually approximately 90°.

According to the invention there is provided a roofing system having a filler member interposed between the roof covering and a support member therefor at the eaves of the system, the filler member being carried by an element which extends inwardly from the support member and which is pivotable thereon, such element engaging a further component of the system beneath the roof covering whereby to locate the filler member at a required inclination for effective engagement with said covering.

Thus, in accordance with the invention the filler member is not fixedly secured to the support member, and therefore its inclination may be varied in accordance with the pitch of the roof. Correct location is achieved by engagement of the inwardly extending element with a further component of the system. In a particularly advantageous embodiment, such component is a roof rafter, or alternatively a batten or the like secured to the rafters, the pitch of which corresponds to the pitch of the roof, whereby the inclination of the filler member depends directly on the pitch of the roof itself, and substantially the same angle of attack relative to the roof covering will be achieved regardless of the pitch of the roof. The element may conveniently be secured directly to the rafters e.g. by nailing.

In a preferred embodiment the element carrying the filler member constitutes a so-called anti-ponding member in the form of a rigid or semi-rigid strip which is adapted to provide support for and thus prevent sagging of a layer of roofing felt located beneath the outer roof covering adjacent the eaves. The filler member itself may take any convenient form, for example an edge portion which is correspondingly shaped to the contours of the roof covering. In a preferred embodiment, however, the filler member comprises toothed comb-like portions which can conform to a variety of different contours and thus have the advantage of being able to accommodate a number of different types of roof tile for example. Such a filler member is described in e.g. EP No. 45489. The lengths of the teeth of the filler may be equal, as is usual with this type of filler, or alternatively the lengths may vary such that the filler is partially shaped to e.g. particular roof tile. In either case the filler member may be secured to the anti-ponding strip by engagement in a transverse channel formed at the front edge thereof. Alternatively the filler member could be integrally formed with the strip. In the case of a tiled roof, the filler member may extend transversly beneath a plurality of tiles, or alternatively individual filler members may be provided for each tile.

It is envisaged that the element carrying the filler member might rest directly on top of a fascia board or the like providing support for the roof covering at the eaves, so as to be pivotable thereon. In a preferred embodiment however a spacer member is secured to the top of the fascia board which defines openings for the flow of air from outside to beneath the roof to increase the ventilation of the roof space, and in such an embodiment the element carrying the filler member may rest on top of the spacer member. A preferred form of spacer member is described in British patent application No. 8407048. The invention is particularly applicable to a roofing system consisting of contoured roof tiles or slates, and in such a system it is important to provide suitable means for securing the tiles or slates at eaves of the roof. In embodiments including a spacer member secured to a fascia board or the like, such means may conveniently comprise tile clips which at their upper ends engage over edge portions of the respective tiles and at their lower ends engage in suitable apertures formed in the spacer member. A spacer member of the type described in the British patent application referred to above includes downwardly facing ventilation apertures, and with such an arrangement a wire tile clip may conveniently be provided which is adapted for engagement in a respective ventilation aperture from below. Alternatively, clips may be provided which engage in respective apertures formed in a forwardly projecting so-called drip edge of the spacer member, such drip edge being provided for the purpose of channeling water impinging thereon into an underlying eaves gutter. In the latter case, a plurality of clip engaging appertures may be formed in the drip edge which are each covered by a readily penetratable membrane whereby those apertures not engaged with a tile clip remain sealed.

A preferred embodiment of the invention will now be described, by way of example only, with reference to the accompanying drawings, wherein:

FIG. 1 is a sectional view of part of the eaves of a roofing system in accordance with the invention;

FIGS. 2*a*, 2*b* and 2*c* are a front elevation, sectional and plan view respectively of the spacer member shown in FIG. 1;

FIGS. 3*a* and 3*b* are a side elevation and a plan view of the anti-ponding strip shown in FIG. 1;

FIGS. 4*a* and 4*b* are front and side elevations of a filler member;

Figure 1:
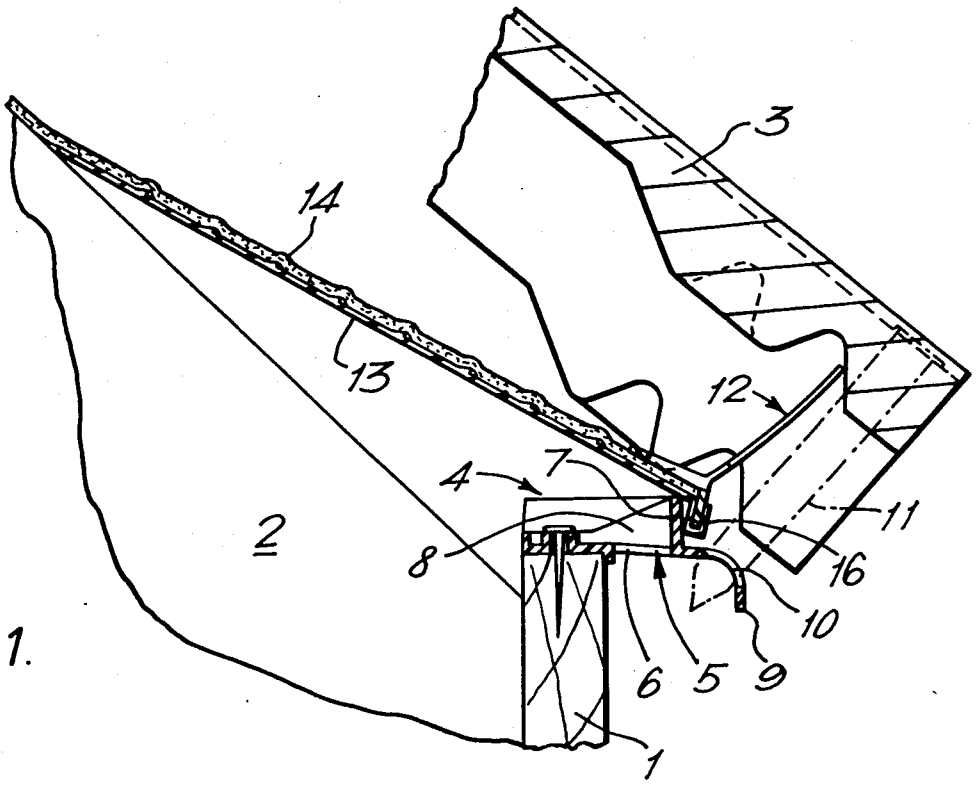
Figures 2A, 2B, 2C:
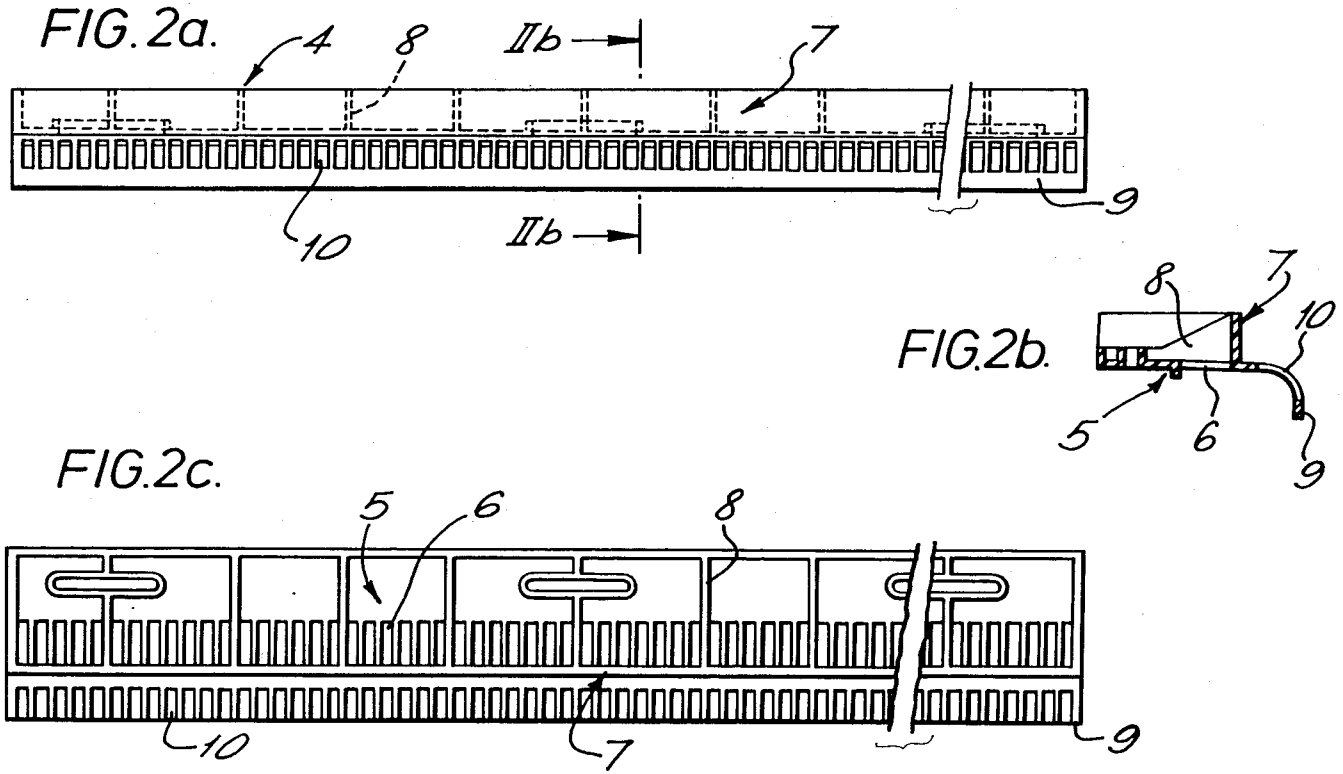
Figure 3A:
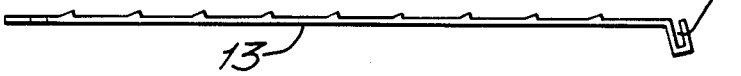
Figure 3B:
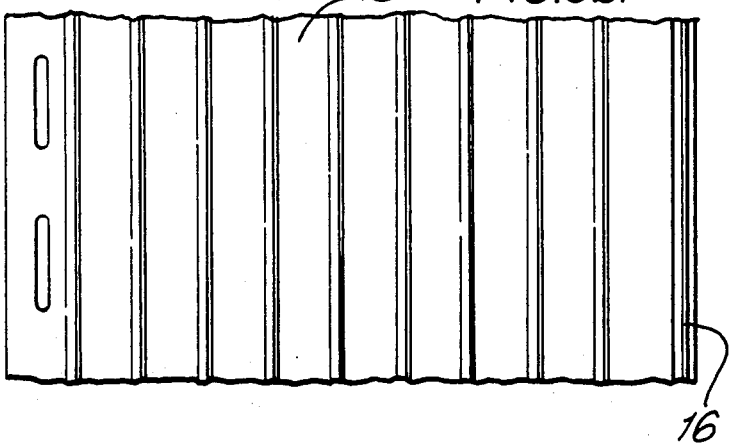

As shown in FIG. 1, the eaves of a roofing system include a fascia board 1 secured to the lower ends of the roof rafters 2 which supports the front edges of the lowermost row of roof tiles 3. Interposed between the tiles 3 and the fascia board is a spacer member 4 of the sort described generally in British patent application No. 8407048. As shown more clearly in FIGS. 2*a*, 2*b* and 2*c*, the spacer member 4, which is nailed to the top of the fascia board 1, includes a first portion 5 adapted to extend outwardly from the fascia board and having a plurality of ventilation apertures 6 formed therein, and an upwardly extending free edge portion 7. Transverse strengthening ribs 8 are provided to prevent bending of the member 4 under the weight of the tiles. Projecting forwardly from the spacer member 4 is a drip edge 9 adapted to channel water impinging thereon into an underlying eaves gutter (not shown). The drip edge 9 is formed with a plurality of slot-like apertures 10 adapted for engagement with a respective tile clip 11 as will be described in more detail below, the apertures being covered by a readily penetratable membrane (not shown) whereby those apertures not engaged by a clip 11 remain sealed.

As shown in FIG. 1 the system further comprises a filler member 12 carried by a rigid or semi-rigid anti-ponding strip 13 which at its front end rests on the free edge portion 7 of the spacer member and at its rear end is secured e.g. by nailing to the rafters 2. The anti-ponding strip 13 is effective to support a layer of roofing felt 14 adjacent the eaves whereby to prevent the felt sagging and forming a water trap and/or blocking the ventilation apertures 6.

Figure 4A:
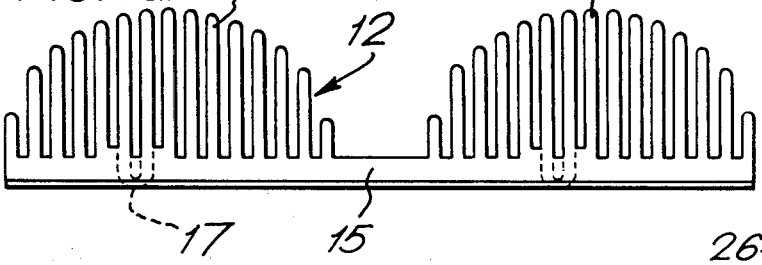
Figure 4B:
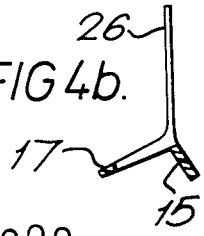
Figure 5:
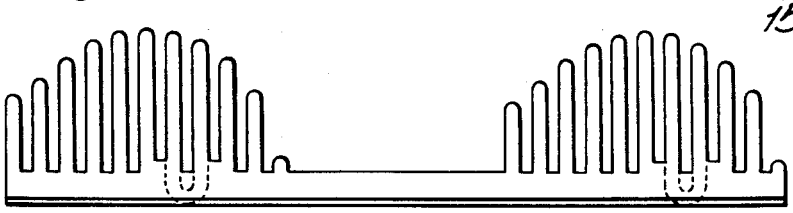
FIG. 5 is a front elevation of an alternative embodiment of filler member.

As shown in FIGS. 4*a* and 4*b* each filler member 12 includes a lower flange 15 adapted for engagement in a transverse channel 16 provided along the front edge of the strip 13, and comprises comb-like filler portions 26 adapted to engage and conform to the shape of the underside of the overlying tile 3. The filler member additionally includes loop fasteners 17 whereby the member may if desired be secured e.g. by nailing directly to the fascia board. Whilst the illustrated embodiment of filler member may adapt to a number of different types of tile, it is envisaged that alternative filler profiles such as that illustrated in FIG. 5 may be required in order to accommodate all the various tile sizes and shapes currently available.

Figure 6:
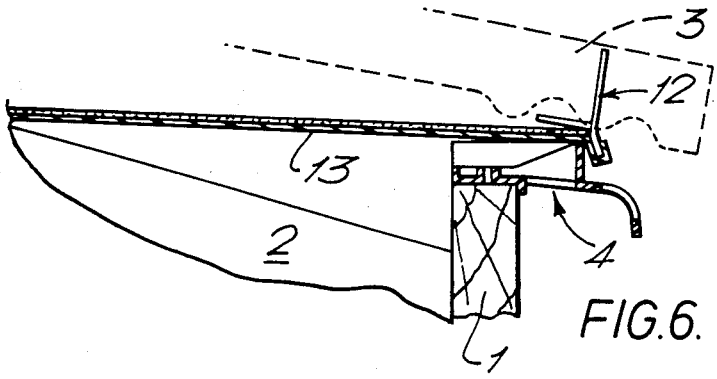
FIGS. 6, 7 and 8 are sectional views on a reduced scale similar to FIG. 1 only illustrating different roof pitches.
Figure 7:
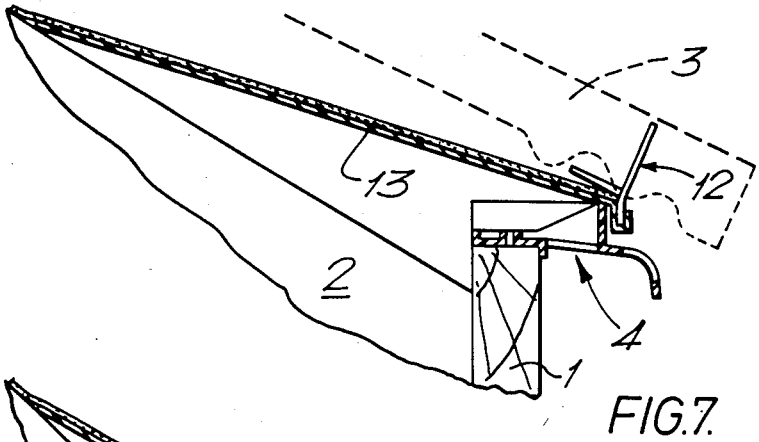
Figure 8:
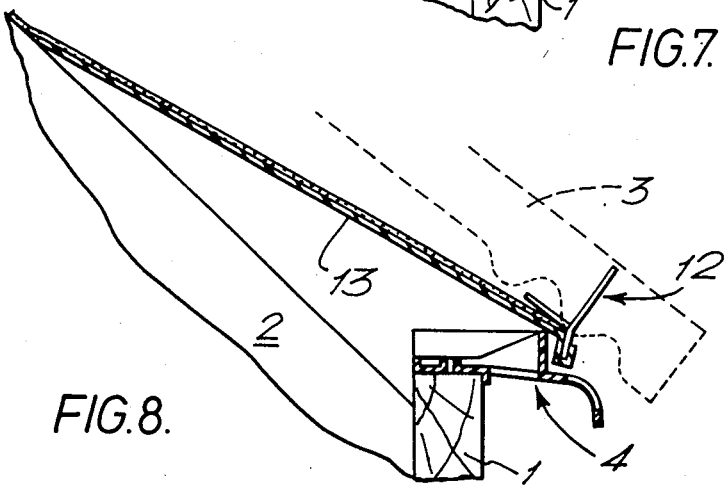

Turning now to FIGS. 6, 7 and 8 it will be seen how a range of different roof pitches may be accommodated with the same filler member 12 and anti-ponding strip 13. By selection of an anti-ponding strip of appropriate width, an appropriate angle of attack of the filler member 12 relative to the tiles 3 of approximately 90° is achieved regardless of the pitch of the roof, the required inclination of the member 12 being set by the engagement of the inner end of the strip 13 with the rafters 2.

Figure 10:
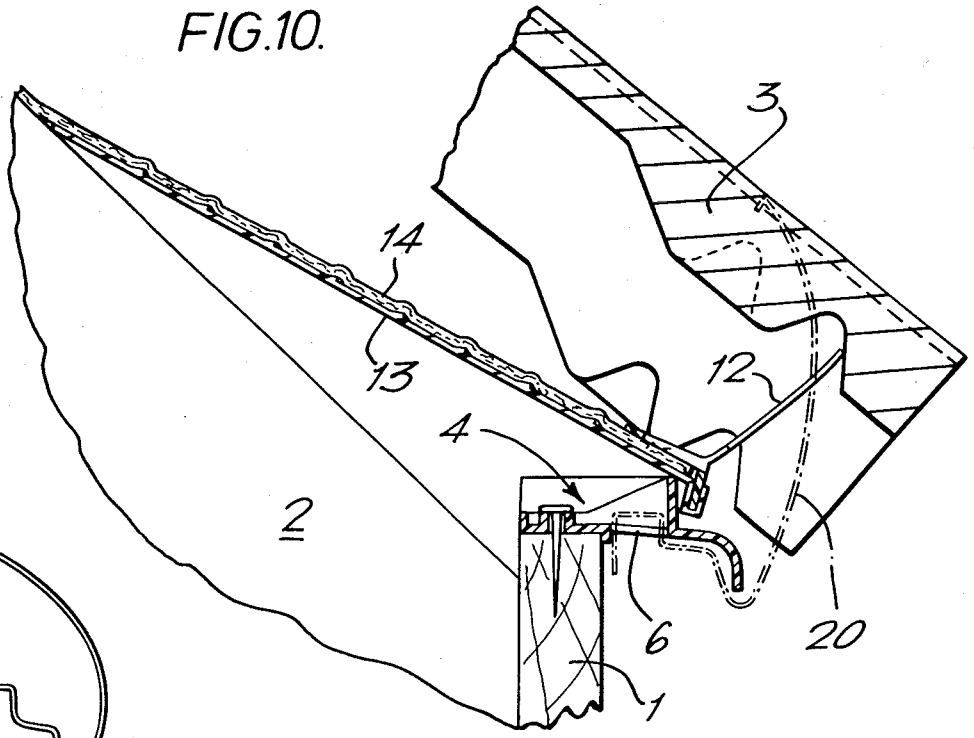
FIG. 10 is a view similar to FIG. 1 only illustrating the use of the tile clip shown in FIG. 9.
Figure 9:
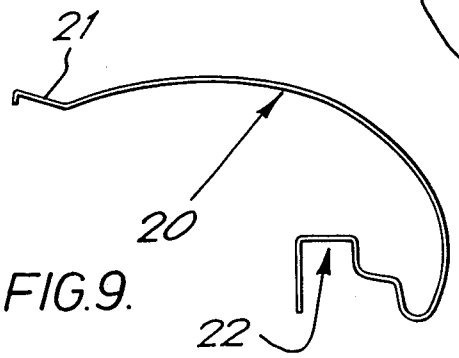
FIG. 9 illustrates an alternative form of tile clip.

As discussed above, the manner in which the tiles are secured at the eaves may vary. Thus, as shown in FIG. 1 an aluminium clip 11 is used which engages in the apertures 10 of the drip edge 9, and may be bent laterally into a condition where subsequent removal is prevented. However, as discussed above, this requires the provision of a readily penetratable membrane covering the apertures 10 to ensure that effective channelling of water into the gutter by the drip edge 9 is unimpaired. An alternative method which avoids this requirement is illustrated in FIGS. 9 and 10 and involves the use of a wire clip 20 having an upper, hook-like portion 21 adapted to engage over an edge portion of a tile, and a lower portion 22 adapted to engage in one of the ventilation apertures 6 of the spacer member 4 whereby to secure the tiles in place.

I claim:

1. A roofing system with eaves comprising:
(a) a roof covering;
(b) a support member for the roof covering at the eaves of the system;
(c) an element extending inwardly from the support member, the element resting on the support member in a readily pivotal manner and engaging a further component of the roofing system beneath the roof covering whereby the element may adapt to different roof pitches; and,
(d) a filler member attached to the element such that the filler member extends at a predetermined inclination with respect to the roof covering for effective engagement therewith.

2. A roofing system as claimed in claim 1 wherein said further component is a roof rafter.

3. A roofing system as claimed in claim 1 further comprising a layer of roofing felt underlying the roof covering and wherein the element carrying the filler member comprises at least a semi-rigid strip which provides support adjacent the eaves for the layer of roofing felt underlying the roof covering.

4. A roofing system as claimed in claim 3 wherein the filler member is secured to the strip by engagement in a channel formed at a front edge of the strip.

5. A roofing system as claimed in claim 1 wherein the filler member comprises toothed comb-like portions.

6. A roofing system as claimed in claim 1 further comprising a spacer member interposed between the roof covering and an underlying fascia board at the eaves, such member defining ventilation openings for the flow of air from outside the roof to the underlying roof space, wherein the filler member and carrying element rest on and the carrying element is in pivotable contact with said spacer member.

7. A roofing system as claimed in claim 6 wherein the roof covering comprises individual units which are secured at the eaves by means of the tile clips engaging at the upper ends thereof over edge portions of the respective individual units and at their lower ends engaging in apertures formed in said spacer member.

8. A roofing system with eaves comprising:
(a) an outer roof covering;
(b) a support member for the roof covering provided adjacent eaves of the roofing system;
(c) roof rafters underlying said outer roof covering;
(d) a layer of roofing felt disposed between said rafters and said outer covering;
(e) an at least semi-rigid strip member extending inwardly from the support member, the strip member resting on the support member in a readily pivotal manner and engaging the roof rafters beneath the outer roof covering and being arranged to provide support for the roofing felt adjacent the eaves whereby the strip member may adapt to different roof pitches; and
(f) a filler member carried by said strip member, such filler member engaging the underside of the outer roof covering at the eaves of the roofing system.

* * * * *